US007427211B2

(12) United States Patent
Yoshikai

(10) Patent No.: US 7,427,211 B2
(45) Date of Patent: Sep. 23, 2008

(54) CONNECTOR

(75) Inventor: Yasuyoshi Yoshikai, Kawasaki (JP)

(73) Assignee: IRISO Electronics Co., Ltd., Kanagawa (JP)

( * ) Notice: Subject to any disclaimer, the term of this patent is extended or adjusted under 35 U.S.C. 154(b) by 0 days.

(21) Appl. No.: 10/599,735

(22) PCT Filed: Jun. 3, 2005

(86) PCT No.: PCT/JP2005/012089

§ 371 (c)(1),
(2), (4) Date: Oct. 6, 2006

(87) PCT Pub. No.: WO2006/095456

PCT Pub. Date: Sep. 14, 2006

(65) Prior Publication Data

US 2007/0207643 A1 Sep. 6, 2007

(30) Foreign Application Priority Data

Mar. 11, 2005 (JP) ..... 2005-068443

(51) Int. Cl.
*H01R 12/24* (2006.01)

(52) U.S. Cl. ..... 439/495

(58) Field of Classification Search ..... 439/495–496
See application file for complete search history.

(56) References Cited

U.S. PATENT DOCUMENTS 5,213,534 A * 5/1993 Gardner et al. ..... 439/495
5,562,487 A * 10/1996 Ii et al. ..... 439/495
6,089,905 A * 7/2000 Shimmyo et al. ..... 439/495
6,162,083 A 12/2000 Seto

FOREIGN PATENT DOCUMENTS

| | | |
|---|---|---|
| JP | 11-074043 | 3/1999 |
| JP | 2000-182697 | 6/2000 |
| JP | 2003-100370 | 4/2003 |
| JP | 2004-165046 | 6/2004 |
| JP | 2005-116495 | 4/2005 |

* cited by examiner

*Primary Examiner*—Briggitte R Hammond
(74) *Attorney, Agent, or Firm*—Lowe Hauptman Ham & Berner LLP

(57) ABSTRACT

A connector prevents insertion of a pressing member into a connector body when an object to be connected is not fully inserted into the connector body. Each lock portion is a non-elastic member. The thickness of a pressing piece of a pressing member is gradually reduced toward its tip end with a gap between each of the lock portions and a fixed piece portion as the maximum. When a flexible cable is not fully inserted into the connector body, the pressing member can not be inserted into the rear of the connector body, and the flexible cable is not electrically connected in an incomplete insertion state. Therefore, disengagement of the flexible cable from the connector body or contact failure caused by displacement between the flexible cable and an elastic piece of each of the terminals can be surely prevented.

5 Claims, 5 Drawing Sheets

(PRIOR ART)

(PRIOR ART)

CONNECTOR

RELATED APPLICATIONS

The present application is based on, and claims priorities from International Application No. PCT/JP2005/012089, filed Jun. 30, 2005 and Japan Application Ser. No. 2005-68443, filed Mar. 21, 2005, the disclosures of which are hereby incorporated by references herein in its entirety.

TECHNICAL FIELD

The present invention relates to a connector for connecting an object to be connected such as a flexible print circuit board (EPC), flexible flat cable (FFC), etc., for example, to a circuit board.

BACKGROUND ART

A prior art connector for connecting an object, such as a flexible printed circuit board or a flexible cable to a circuit board includes a connector body into which one end of the object can be inserted at a predetermined position. Plural terminals on the object to be connected are inserted into the connector body. The connector also includes a pressing member for pressing the object to be connected which is inserted into the connector body on each of the terminals side. The pressing member desirably prevents (1) disengagement of the object to be connected from the connector body or (2) occurrence of contact failure due to displacement between the connector body and the object by holding the object to be connected.

However, with this connector, as shown in FIGS. 8 and 9, even when an object B to be connected is not fully inserted into a connector body 1, pressing member 3 can be inserted into the connector body 1 in some cases. In this case, since a contact area between the pressing member 3 and the object B to be connected and inserted into the connector body 1 becomes small, a pressing force of the pressing member 3 against the object B to be connected is insufficient, and the object B to be connected might become disengaged from the connector body 1 or displacement between the object to be connected B and an elastic piece portion 2*a* of each of the terminals 2 might result in contact failure.

Then, such a connector is known in which an elastic support piece is provided on both ends in the terminal arranging direction of the connector body, and notch portions on both side ends of the object to be connected are fitted with the elastic support pieces and locked when the object to be connected is inserted into the connector body, so that movement of the object to be connected in the direction opposite to insertion is regulated (see Patent Document 1, for example).

However, when the pressing member is inserted into the connector body in the state where the object to be connected is not fully inserted into the connected body, by pressing of the pressing member on the object to be connected, the elastic support piece is elastically deformed toward the terminal side together with the object to be connected. As a result, the pressing member can be inserted into the connector body even if the object to be connected is not fully inserted into the connector body. Therefore, since the object to be connected is connected in the state where the pressing force of the pressing member against the object to be connected is not sufficient as mentioned above, disengagement of the object to be connected from the connector body or contact failure caused by displacement can not be prevented.

[Patent Document 1]: Japanese Patent Publication 2003-100370

The present invention was made in view of the above problems and has an object to provide a connector which prevents a pressing member from being inserted into a connector body when an object to be connected is not fully inserted into the connector body.

DISCLOSURE OF THE INVENTION

The present invention is so constituted that, in a connector provided with a connector body to which one end of an object to be connected can be inserted at a predetermined position, a plurality of terminals in contact with the object to be connected inserted into the connector body and a pressing member for pressing the object to be connected to each of the terminals side, in which a lock portion is projected on both ends in the terminal arranging direction of the connector body and when the object to be connected is inserted into the connector body, notch portions provided on both side ends of the object to be connected are fitted with the lock portion and locked in the direction opposite to insertion, the lock portion is formed by a non-elastic member and insertion of the pressing member into the connector body is allowed in the state where the notch portions of the object to be connected which has been inserted into the connector body are fitted with the lock portion.

The foregoing structure is arranged so that when the object to be connected is fully inserted into the connector body, that is, when the notch portion of the object to be connected engages the lock portion, the pressing member can be inserted into the connector body. Also, when the object to be connected is not fully inserted into the connector body, that is, when the notch portion of the object to be connected is not engaged with the lock portion, but the object to be connected nevertheless goes onto the lock portion, the lock portion is not deformed towards the terminal side even if the pressing member is to be inserted and the pressing member can not be inserted into the connector body, since the lock portion is formed by a non-elastic member.

The above object and other objects, characteristics and advantages of the present invention will be made clear by the description below and attached drawings.

According to the present invention, when the object to be connected is not fully inserted into the connector body, the pressing member cannot be fully inserted into the connector body. Thus, the object to be connected is not connected to a circuit board in the state where the object to be connected is not fully inserted. Therefore, disengagement of the object to be connected from the connector body or contact failure caused by displacement between the object to be connected and each of the terminals can be surely prevented.

DETAILED DESCRIPTION OF THE DRAWING

Figure 1:
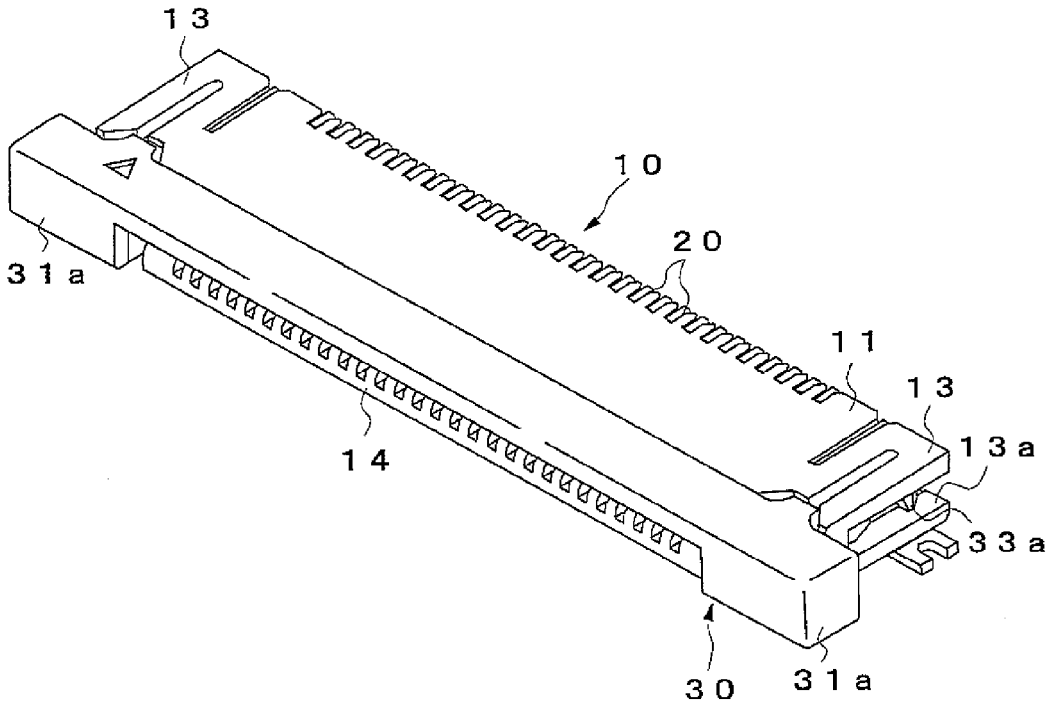
FIG. 1 is a perspective view of a connector according to a preferred embodiment of the present invention.
Figure 2:
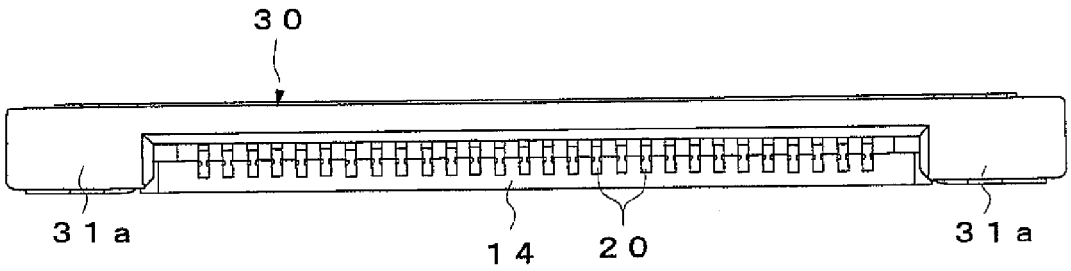
FIG. 2 is a front view of a connector.
Figure 3:
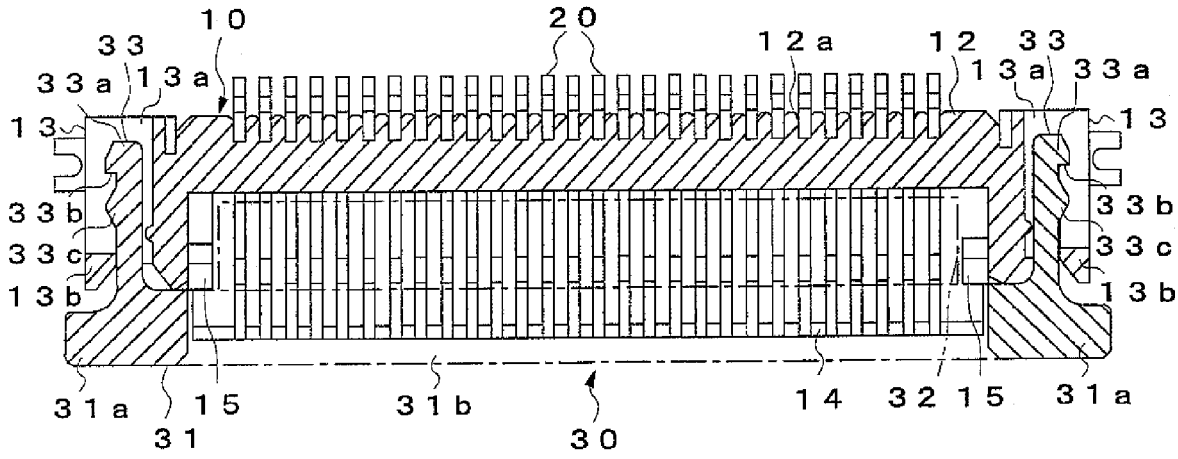
FIG. 3 is a plan view of a connector.
Figure 4:
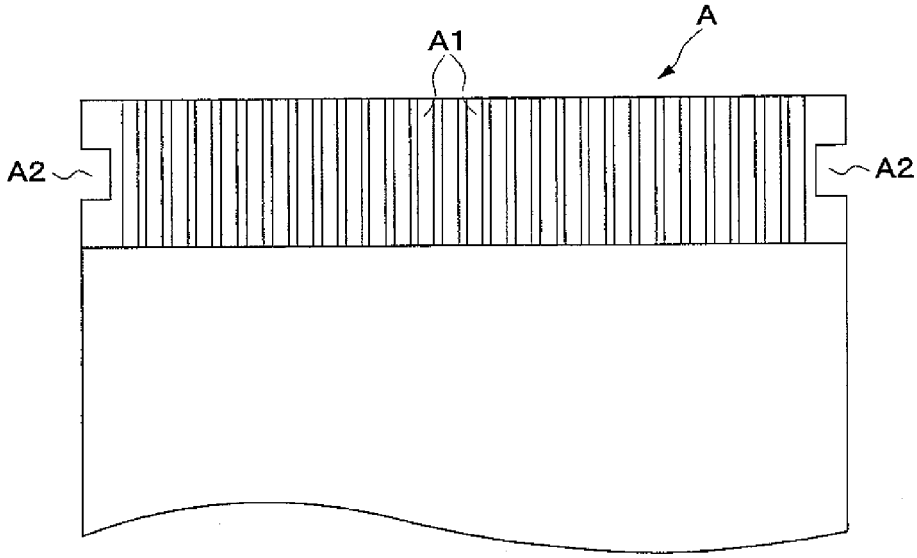
FIG. 4 is a plan view of a flexible cable.
Figure 5:
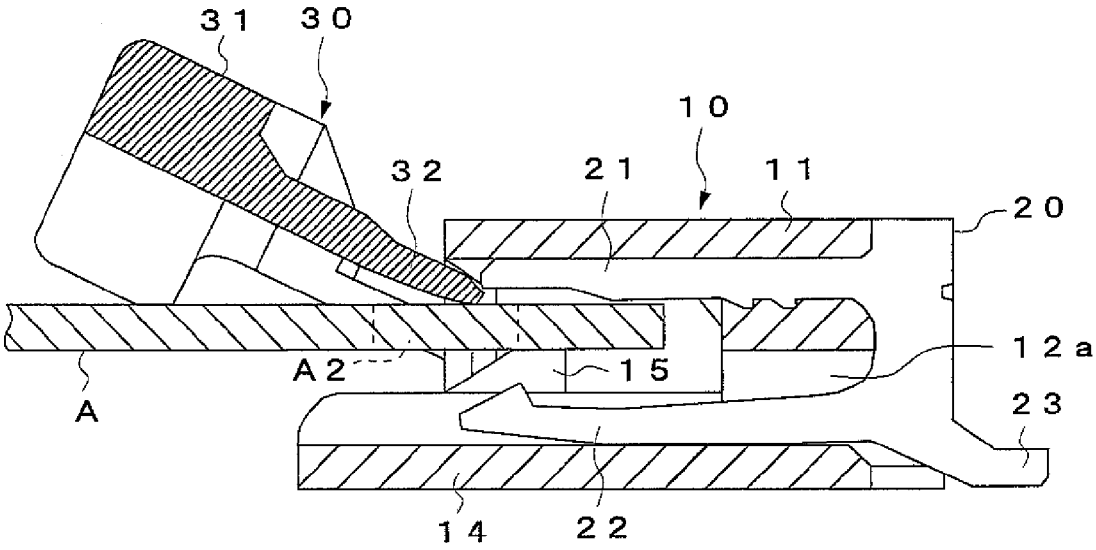
FIG. 5 is a side sectional view showing operation of a connector.
Figure 6:
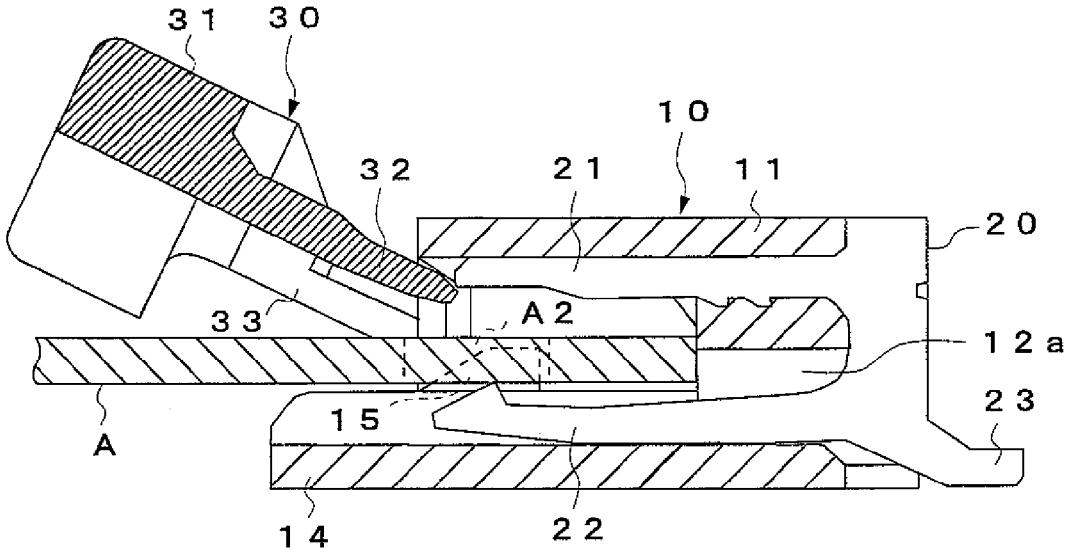
FIG. 6 is a side sectional view showing operation of a connector.
Figure 7:
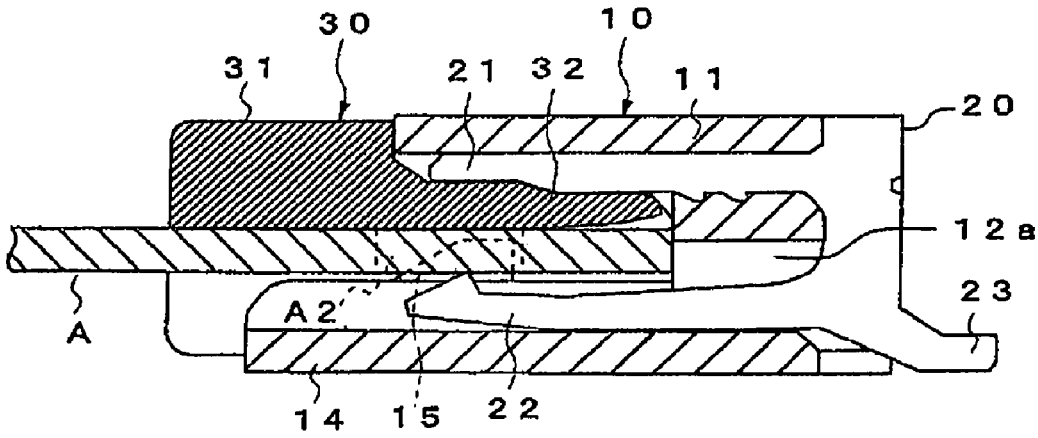
FIG. 7 is a side sectional view showing operation of a connector.
Figure 8:
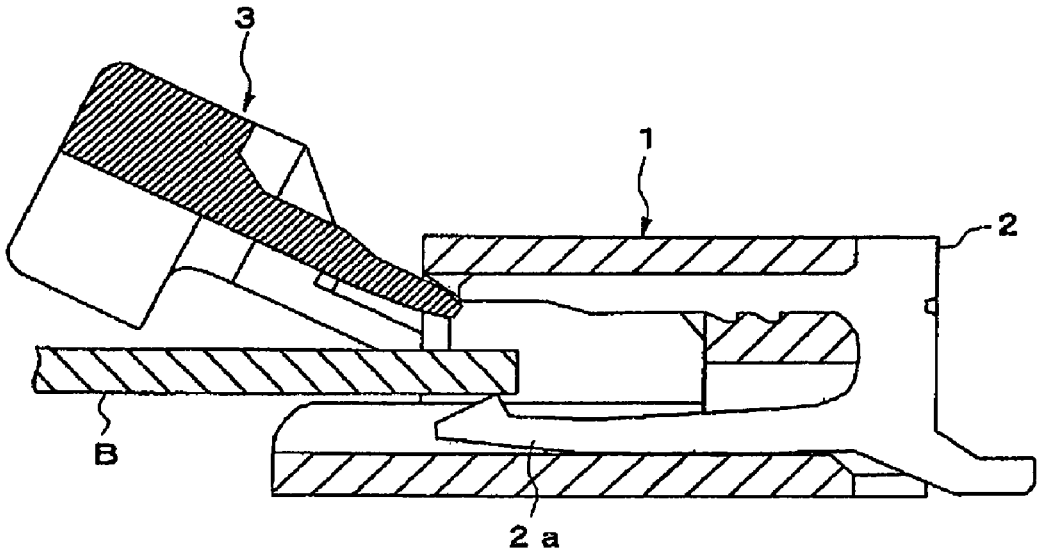
FIG. 8 is a side sectional view showing operation of a conventional connector.
Figure 9:
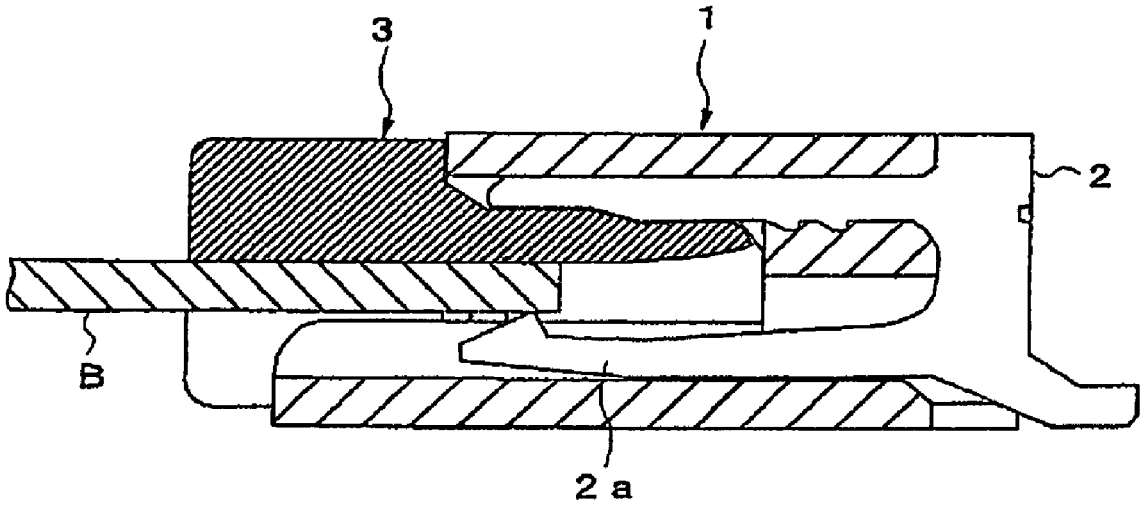
FIG. 9 is a side sectional view showing operation of a conventional connector.

FIGS. 1 to 7 show a preferred embodiment of the present invention, in which FIG. 1 is a perspective view of a connector, FIG. 2 is a front view of a connector, FIG. 3 is a plan view of a connector, FIG. 4 is a plan view of a flexible cable, and FIGS. 5 to 7 are side sectional views showing operation of a connector.

This connector includes connector body 10 into which one end of an object in the form of a flexible cable A to be connected can be inserted. Body 10 carries plural terminals 20 that are arranged to be in electric contact with electrically conducting contacts A1 of the flexible cable A when the cable is inserted into the connector body. The connector also includes pressing member 30 for pressing the flexible cable A against each of terminals 20.

The flexible cable A is is preferably a so-called flexible flat cable (FFC), having a plurality of conductive portions A1. Portions A1 are on both the upper and lower surfaces at its tip end A1 with an interval to each other in the width direction. Also, each side wall of flexible cable A has a notch portion A2 (FIGS. 4-7) that is set back slightly from the tip end of the cable.

The connector body 10 is a molded product made of a non-elastic material (synthetic resin, for example) and has a front end with an open box configuration. That is, connector body 10 has an upper face portion 11, a back face portion 12 (FIG. 3), side face portions 13 and a bottom face portion 14. Flexible cable A is inserted into connector body 10 through the front face opening of body 10. Back face portion 12 includes plural terminal holes 12*a* spaced from each other by equal intervals in the width direction. One of the terminals 20 is held in place in each of terminal holes 12*a*. Each of side face portions 13 has an elongated hole 13*a* extending in the fore-and-aft directions. Pressing member 30 engages each of the elongated holes 13*a*. Pressing member 30 locks a front end portion 13*b* of each of the elongated holes 13*a*. On both ends of each of the terminal holes 12*a* in the arranging direction, right and left lock portions 15, integrally formed with the connector body 10, project upward. Each of the notch, i.e., opening portions A2 of flexible cable A is locked by each of lock portions 15, to prevent movement of cable A in the direction opposite to the insertion direction of the flexible cable A. Also, each of lock portions 15 is locked above the upper surface of lower portion 22 of each of the terminals 20. Each of lock portions protrude in the contact direction with flexible cable A. The front end of each of lock portions 15 has an ascending inclination toward the rear of the connector body 10.

Each of the terminals 20 is made of a conductive metal plate and is respectively held in place by each of the terminal holes 12*a* of the connector body 10. Each of the terminals 20 has a fixed upper portion 21 and an elastic lower portion 22 extending in a bifurcated state. The bottom surface of portion 21 is spaced from the upper surface of portion in the vertical direction. The rear end of each terminal 20 (i.e., the portion of each terminal opposite from the ends of the front of the terminal that receives the top of cable A) has a foot 23 that forms a board connection portion to be connected to a printed circuit board (not shown).

The pressing member 30 is a molded product made of a synthetic resin and includes a manipulation portion 31 arranged outside the connector body 10, a pressing piece 32 arranged within the connector body 10 and right and left arm portions 33 adapted to be inserted into the connector body 10. The manipulation portion 31 extends in the width direction of the pressing member 30 and a gripping portion 31*a*. (FIG. 3) projects outwardly from opposite ends of member 30. Also, the center lower face of manipulation portion 31 includes a recess 31*b* through which the flexible cable A can be inserted. The pressing piece 32 extends rearwardly from the center on the back face of the manipulation portion 31. Pressing piece 32 is located below the fixed, upper portion 21 of each of terminals 20. Also, pressing piece 32 is formed so that the thickness dimension thereof gradually decreases toward the tip end so there is a maximum gap between each of lock portions 15 and the fixed upper piece 21 at the tip ends. Each of the arm portions 33 of pressing member 30 extends rearwardly from both ends on the back face of manipulation portion 31. Each of arm portions 33 is inserted into each of the elongated holes 13*a* of the connector body 10, respectively, and can move in the fore-and-aft directions. The tip end of each of the arm portions 33 includes a lock piece 33*a* (FIG. 3) adapted to be locked by the front end portion 13*b* of the elongated hole 13*a*. Lock piece 33*a* protrudes in the width direction. The front face of the lock piece 33*a*, that is, the face locked by the front end portion 13*b* of each of the elongated holes 13*a*, has an inclined surface 33*b* having a rearwardly descending inclination. Also, at the center in the fore-and-aft direction of each of the arm portions 33 is an angular projection portion 33*c*. Portion 33*c* projects from arm portion 33 in the width direction. When arm portion 33 is moved in the fore-and-aft direction, projection portion 33*c* forcibly overrides front end portion 13*b* of the elongated hole 13*a* as a result of elastic deformation of the arm portion 33.

In the connector as described above, by soldering the board connection portion 23 of each of the terminals 20 to a board, each of the terminals 20 is connected to the board. Also, when the flexible cable A is to be connected to the connector, by pushing the pressing member 30 forward (i.e., by starting to push the pressing member toward upper portion 21 as shown in FIG. 5, flexible cable A can be inserted into the connector body 10. To this end, the thickness dimension of the pressing piece 32 of the pressing member 30 gradually decreases toward the tip end side, where the gap between each of the lock portions 15 and the fixed piece portion 21 is greatest. When pressing member 30 is moved forward, a gap between each of the lock portions 15 and the pressing piece 32 is widened, and the flexible cable A can be inserted between each of the lock portions 15 and the pressing piece 32. Also, when the pressing member 38 is urged forward, the projection portion 33*c* of each of the arm portions 33 overrides the front end portion 13*b* of the elongated hole 13*a* and the lock piece 33*a* of the arm portion 33 is locked by the front end portion 13*b* of the elongated hole 13*a*, so pressing member 30 is held at the forward position. At that time, the inclined surface 33*b* of the lock piece 33*a* (1) is brought into contact with the front end portion 13*b* of the elongated hole 13*a*, and (2) tends to be perpendicular along the front end portion 13*b* of the elongated hole 13*a* by the holding force of projection portion 33*c* against the front position of the pressing member 30. By this, as shown in FIG. 5, the pressing member 30 is moved rotationally upward and its front end side is raised, to facilitate insertion of the flexible cable A.

Next, when the flexible cable A is inserted into the connector body 10, both ends in the width direction at the tip end of the flexible cable A are brought into contact with the front end of each of the lock portions 15. Then, cable A goes onto the upper face of each of the lock portion 15 while being guided by the inclined surface on the front end of each of lock portions 15. And as shown in FIG. 6, when the flexible cable A is further inserted toward the rear of the connector body 10, each of the notch portions A2 of the flexible cable A and each of the lock portions 15 of the connector body 10 are fitted with each other and the flexible cause A is moved downward. Then, each of conductive portions A1 of the flexible cable A comes into contact with the elastic portion 22 of each of the terminals 20, and each of the notch portions A2 of the flexible cable A is locked by each of the lock portions 15. Consequently, flexible cable A is fully inserted into the connector body 10. A this time, since no portion of the flexible cable A is between the upper face of each of the lock portions 15 and the fixed upper lower terminal portion 21, when the pressing piece 32 of the pressing member 30 is inserted toward the rear of the connector body 10, the gap between the pressing piece 32 and the elastic lower portion 22 is gradually narrowed through the flexible cable A, and the flexible cable A is pressed onto the elastic piece portion 22 side by the pressing piece 32. And as shown in FIG. 7, the pressing member 30 is inserted into the connector body 10 and the flexible cable A and the elastic piece portion 22 of each of the terminals 20 are brought into pressure contact with each other and electrically connected.

Also, in the state where the flexible cable A is not fully inserted, that is, the flexible cable A is not inserted to the position where each of the notch portions A2 of the flexible cable A is fitted with each of the lock portions 15 and the flexible cable A goes to each of the lock portions 15, when the pressing member 30 is to be inserted toward the rear of the connector body 10 while being rotated downward, since the thickness dimension of the pressing piece 32 is larger than the gap between the flexible cable A which has gone on to the upper face of each of the lock portions 15 and the fixed piece portion 21 of each of the terminals 20, the pressing member 30 can not be inserted to the rear of the connector body 10. At that time, even if the flexible cable A is pressed downward by the pressing member 30, each of the lock portions 15 made of a non-elastic member is not deformed, and a gap through which the pressing member 30 is inserted can not be formed.

In this way, according to the connector of this preferred embodiment, since each of the lock portions 15 is a non-elastic member and the thickness dimension of the pressing piece 32 of the pressing member 30 is formed so that it gradually narrows toward the tip end with the gap between each of the lock portions 15 and the fixed piece portion 21 as the maximum, when the flexible cable A is fully inserted into the connector body 10, that is, when each of the notch portions A2 of the flexible cable A is fitted with each of the lock portions 15, the pressing member 30 can be inserted into the connector body 10. When the flexible cable A is not fully inserted into the connector body 10, that is, when each of the notch portions A2 is not fitted with each of the lock portions 15 and the flexible cable A goes on to each of the lock portions 15, the pressing member 30 can not be inserted into the rear of the connector body 10, and the flexible cable A is not connected in an incomplete inserted state. Therefore, disengagement of the flexible cable A from the connector body 10 or contact failure caused by displacement between the flexible cable A and the elastic portion 22 of each of the terminals 20 is surely prevented.

Moreover, since each of the lock portions 15 is integral with the connector body 10, contact with the flexible cable A resulting in displacement of each of the lock portions 15 and non-fitting between the notch portion A2 of the flexible cable A and each of the lock portions 15 is prevented, and when the flexible cable A is fully inserted, each of the notch portions A2 of the flexible cable A can be surely fitted with each of the lock portions 15 and the flexible cable A can be pressed by the pressing member 30.

Moreover, since the front end of each of the lock portions 15 is upwardly inclined toward the rear of the connector body 10, when both ends, in the width direction, of the tip end of the flexible cable A are brought into contact with the front end of each of the lock portions 15, the flexible cable A can be easily inserted to the rear of the connector body 10 by going onto the upper face of each of the lock portions 15 while being guided by the inclined surface of the front end of each of the lock portions 15. Therefore, advantageously, when the flexible cable A is inserted into the connector body 10, insertion is not prevented by contact between the tip end of the flexible cable A and the front end of each of the lock portions 15.

Moreover, since each of the lock portions 15 is formed so that it is above the upper face of lower portion 22 of each of the terminals 20 in the direction in contact with the flexible cable A, that is, protruding upward, when the flexible cable A is inserted into the connector body 10, none of the conductive portions A1 of the flexible cable A is not brought into contact with any of terminals 20. Therefore, damage (such as streaks on each of the conductive portions A1 of the flexible cable A) due to contact with each of the terminals 20 is surely prevented.

In the above preferred embodiment, an example in which each of the lock portions 15 is formed integrally with the connector body 10 is shown, but a lock portion made of a non-elastic member different from the connector body 10 may be provided on the connector body 10.

The invention claimed is:

1. A connector for connecting contacts at an end of an object in the form of a flexible printed circuit board or a flexible flat cable to circuit board contacts, the object having openings on opposite longitudinal sides thereof, the contacts of the object being between the longitudinal sides, the connector comprising:

an electric insulating body carrying plural electrically conducting terminals, each of the plural terminals including first and second structures for respectively electrically connecting one of the contacts of the object to one of the circuit board contacts, the first structure including a fixed portion and a flexible portion, the fixed and flexible portions having opposed surfaces forming a mouth for receiving the end of the object;

the electric insulating body including non-elastic first and second lock portions for respectively and selectively engaging the openings on the object while the end of the object is in the mouth;

a pressing member for selectively pushing the object into the mouth;

the pressing member, lock portions and the fixed and flexible portions being arranged so that (a) while the pressing member is pushing the object into the mouth none of the contacts of the object contact any portions of the terminals, and (b) upon completion of the pushing by the pressing member of the object into the mouth that causes the lock portions to engage the openings and hold the object in place and while the pressing member is fully inserted in the mouth, the contacts at the end of the object engage and are electrically connected to the terminals.

2. The connector according to claim 1, wherein said lock portion is formed integrally with the connector body.

3. The connector according to claim 1, wherein a front end of each of said lock portions is formed so that it is upwardly inclined toward the rear of the connector body.

4. The connector of claim 1 wherein the lock portions are above an upper surface of the flexible portion while the connector is oriented so the flexible and fixed portions extend horizontally and the flexible portion is below the fixed portion.

5. The connector of claim 4 wherein (a) the pressing member includes a pressing piece for engaging a top surface of the object while the connector is oriented so the flexible and fixed portions extend horizontally and the flexible portion is below the fixed portion and while the pressing member pushes the object into the mouth, (b) the mouth is wide enough between the opposed surfaces of the fixed and flexible portions so that the pressing piece and the object can fit between the opposed surfaces without the object contacting the opposed surfaces while the pressing member is pushing the object, and (c) the fixed and flexible portions and the pressing piece are arraigned so that when the pressing piece is fully inserted into the mouth the pressing piece engages the opposed surface of the fixed portion and a surface of the object engages and electrically contacts the opposed surface of the flexible portion.

* * * * *